US005771668A

United States Patent [19]

Younger

[11] Patent Number: 5,771,668

[45] Date of Patent: Jun. 30, 1998

[54] REMOTE BUCKLE RELEASE DEVICE

[76] Inventor: James C. Younger, 5222 Highway 151, Box 41, Platteville, Wis. 53818

[21] Appl. No.: 700,843

[22] Filed: Aug. 21, 1996

[51] Int. Cl.[6] ..... B68B 1/00

[52] U.S. Cl. ..... 54/1

[58] Field of Search ..... 54/1; 119/772, 119/859

[56] References Cited

U.S. PATENT DOCUMENTS 2,608,812 9/1952 Hutchings ..... 54/1 X 3,616,595 11/1971 Townsend ..... 54/1

*Primary Examiner*—Robert P. Swiatek

*Attorney, Agent, or Firm*—Zarley, McKee, Thomte, Voorhees, & Sease

[57] ABSTRACT

A remote release device is adapted to secure a bull rope around the chest of a rodeo bull. The release device includes a radio receiver which receives signals transmitted from a remote transmitter and causes a latching mechanism to release the bull rope from the bull. The transmitter is activated by a person when the bull rider is thrown and is unable to let go of the bull rope. In this way, the bull rider avoids injury.

12 Claims, 3 Drawing Sheets

REMOTE BUCKLE RELEASE DEVICE

BACKGROUND OF THE INVENTION

1. Field of the Invention

The present invention relates to rodeo equipment. More particularly, the present invention relates to a safety device for remotely releasing a bull rope from an animal.

2. Problems in the Art

In a bull riding contest at a rodeo, a bull is trained to buck while a rider attempts to remain on the bull for a specified period of time. The rider is allowed to hold on to the bull with one hand via a bull rope or rigging. When the specified time period has expired or the rider is thrown from the animal, the rider will attempt to let go of the bull rope or saddle rigging to become separated from the animal.

A typical prior art bull rope is comprised of a rope which can be wrapped around the chest of the animal immediately behind the front legs. A typical prior art bull rope is comprised of a tweed rope with a loop in one end and a handle formed between the two ends. A bull rider will wrap the bull rope around the chest of the animal and insert the end of the bull rope through the loop in the other end. The rider then pulls the rope toward the handle and holds on to the end of the rope to secure the rope to the bull. Since the object of bull riding is to stay on the bull, bull riders want a very secure and tight bull rope. Riders typically wear leather gloves. To tightly secure the bull rope, bull riders will spread rosin on their gloves and on the rope. The rope is then wrapped tightly around the riders hand and wrist with the rosin helping to secure the bull rope. When the rider is thrown or the specified time period has expired, the rider will attempt to let go of the rope in order to dismount from the animal.

Occasionally, when a rider is thrown from the animal, the rider's hand remains secured to the bull rope because of the tight grip described above. When this happens, the rider may be dragged by the arm along side of the animal at which time the rider can be stepped on, kicked, or otherwise injured. Once a bull rider is thrown without releasing this secure grip, the bull riders is almost helpless until a rodeo clown or other person is able to release the grip. This situation has resulted in serious injuries, including many which are crippling and even fatal. Another effect of this problem is that riders tend to practice less than desired because of the risk of getting hurt. The lack of practice add further to the danger of the sport.

It can be seen that the rider has a significant incentive to tightly secure one hand to the bull rope or saddle rigging as securely as possible in order to remain on the animal for the specified period of time. Unfortunately, as the grip on the bull rope becomes more secure, it is harder for the rider to release the hand from the animal when thrown. It can also be seen that there is a need for safety devices in this very dangerous sport. One prior art approach attempts to stop the animal from bucking after the specified time period has elapsed to protect the rider. U.S. Pat. No. 3,733,530 issued to Labart uses a radio controlled latch attached to a bucking strap to remotely release the bucking strap from the animal. While this device may help to calm the animal, the device does not help the riders release their hands from the bull rope or saddle rigging. As a result, a rider may still be hung up on the animal even after the bucking strap is released. So, regardless of whether the animal stops bucking, the rider is still in danger when one hand is caught in the bull rope. Many riders have been injured even after the bucking strap has been released since the animals commonly continue to buck. So it can be seen that while this particular prior art device may help calm the animal, a separate and unrelated problem still exists—a rider's hand being hung up in the bull rope. The prior art does not teach, suggest, or even acknowledge a solution to this hazard. There is no known prior art device which allows the rider to quickly become detached from the animal after being thrown while at the same time allowing the rider to tightly secure one hand to the animal.

FEATURES OF THE INVENTION

A general feature of the present invention is the provision of a remote release safety device which secures a bull rope to a rodeo animal.

A further feature of the present invention is the provision of a remote release safety device which is used on the bull rope of a rodeo animal so that the bull rope can be released from the animal after a rider is thrown.

A further feature of the present invention is the provision of a remote release safety device which includes an electrically actuated fastening device to allow a bull rope to be remotely released from an animal.

A further feature of the present invention is the provision of a remote release safety device having a radio receiver for receiving a radio signal from a transmitter for remotely releasing the device from a rodeo animal.

A further feature of the present invention is the provision of a remote release safety device for use on bull ropes of rodeo animals in order to prevent injuries and deaths to riders.

These as well as other features of the present invention will become apparent from the following specification and claims.

SUMMARY OF THE INVENTION

The remote release safety device of the present invention is used by rodeo participants to attach a bull rope to an animal in such a way that the bull rope can be remotely released if the rider is thrown from the animal and cannot release his hand from the bull rope. The invention is comprised of a buckle release device which is actuated when a radio signal is received by a receiver. The receiver receives signals from a transmitting device controlled by a person other than the rider. When the rider is thrown from the animal and is unable to let go of the bull rope, the transmitter can be activated which causes the remote buckle release device to release the bull rope which allows the rider to safely separate from the animal.

DETAILED DESCRIPTION OF THE PREFERRED EMBODIMENT

The present invention will be described as it applies to its preferred embodiment. It is not intended that the present invention be limited to the described embodiment. It is intended that the invention cover all alternatives, modifications, and equivalences which may be included within the spirit and scope of the invention.

Figure 1:
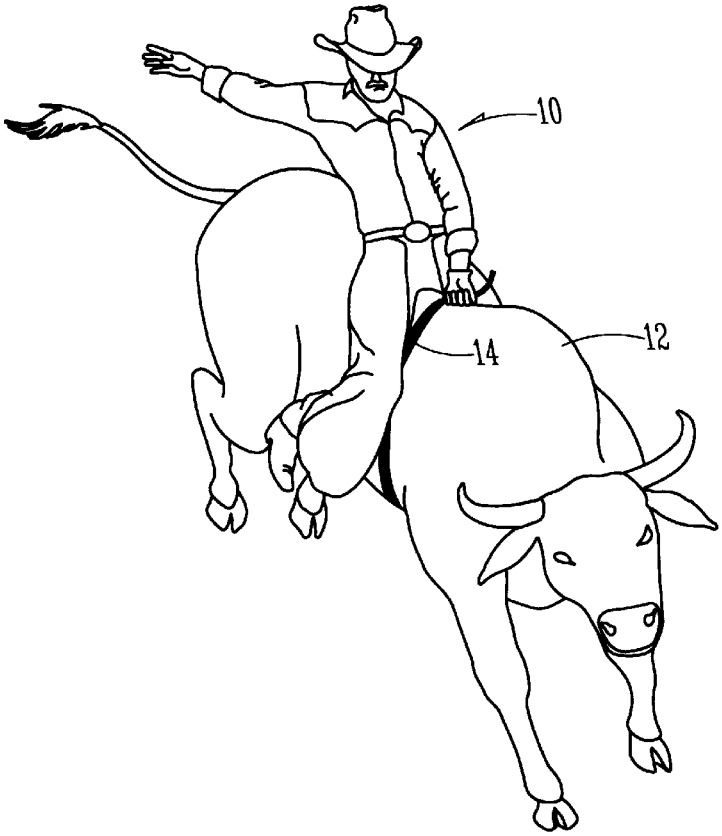
FIG. 1 is a perspective view of a bull rider riding a bull.

FIG. 1 shows a bull rider 10 riding a bull 12 while using a bull rope 14 of the present invention. Attached to the bull rope 14 is a releasable latching mechanism 16 which can not be seen in FIG. 1, since it is positioned underneath the bull. The bull rope 14 is preferably comprised of a tweed rope and is wrapped around the chest of the bull 12 immediately behind the front legs. A bull rider 10 will grasp the rope 14 near the portion of the rope on the bull's back to tightly secure the rider's hand to the bull rope 14. The rope wraps around the chest of the animal and is held together by inserting the end of the rope 14 through a loop and then holding on to the end while also wrapping the rope around the hand of the rider.

The bull rope 14 will remain secured to the bull 12 until the end of the rope is released by the rider or the buckle release device 16 of the present invention is released.

Figure 2:
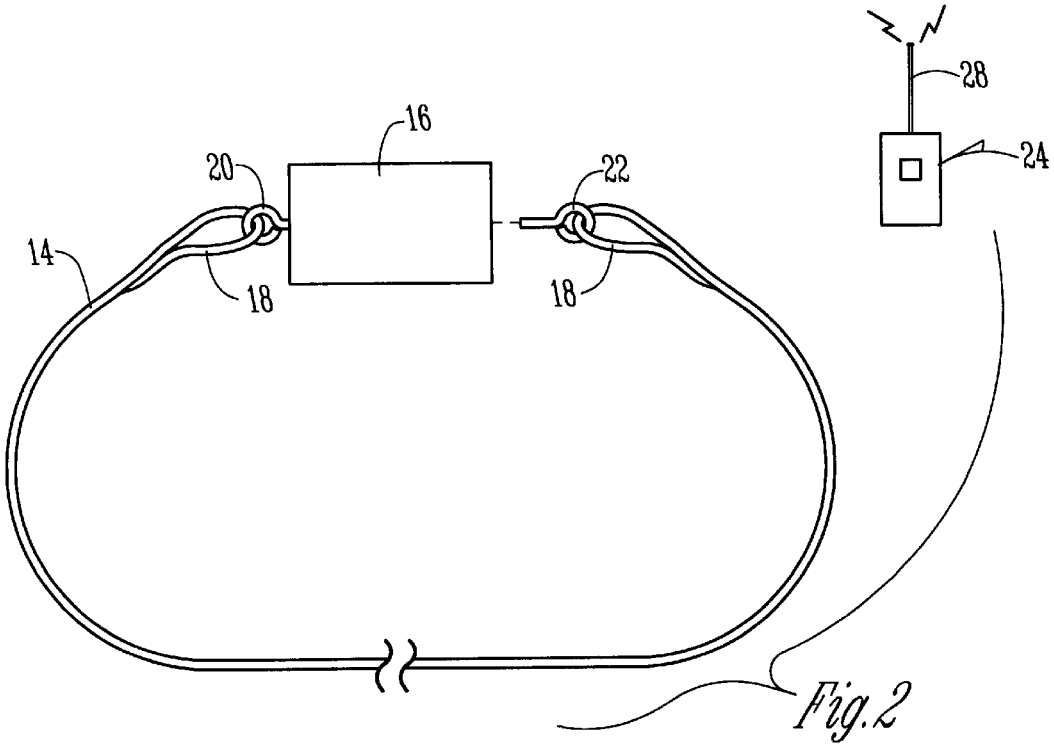
FIG. 2 is a perspective view of the bull rope and remote release safety device of the present invention.

FIG. 2 shows the bull rope 14 with the remote buckle release device 16 of the present invention. The bull rope 14 is comprised of a tweed rope with a loop (not shown) at one end. A remote buckle release device 16 is also connected to the rope 14. As shown in FIG. 2, the bull rope 14 is attached to the remote release device 16 by a pair of loops 18 inserted through first and second eyebolts 20 and 22. FIG. 2 shows the eyebolt 22 in the released position, with a dotted line showing where it attaches to the remote latch 16.

FIG. 2 also shows a remote transmitting device 24 which is used to transmit a signal to the remote release device 16. When the buckle release device 16 receives the appropriate signal from the remote 24, it releases the bull rope 14 from the bull 12.

Figure 3:
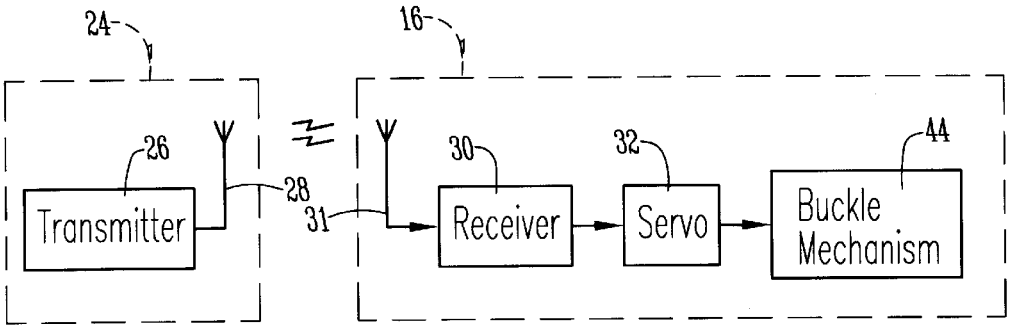
FIG. 3 is a block diagram of the present invention.

FIG. 3 is a block diagram of the remote buckle release device 16. FIG. 3 shows the transmitting device 24 and the remote buckle release device 16. The transmitting device 24 includes a conventional radio transmitter 26 and a conventional antenna 28. When the transmitter 24 is activated, it transmits a signal via the antenna 28. The receiver 30 within the buckle release device receives the transmitted signal via the antenna 31. The receiver 30 is preferably a 2-channel receiver. When a signal is received by the receiver 30, a control signal is sent to an electrical actuator (e.g., servo 32) which actuates a buckle mechanism and releases the bull rope 14. Of course, the block diagram of FIG. 3 shows only one possible configuration for the present invention, as any number of configurations are possible. For example, rather than radio signals, other signals could be used such as light signals, sonic signals, etc. The receiver antenna 31 is preferably contained within the housing of the buckle release device 16, although an external antenna could also be used. The antenna 31 shown in FIG. 4 is a 20 inch wire antenna which is glued to the inside surface of the housing 34 of the device 16.

Figure 4:
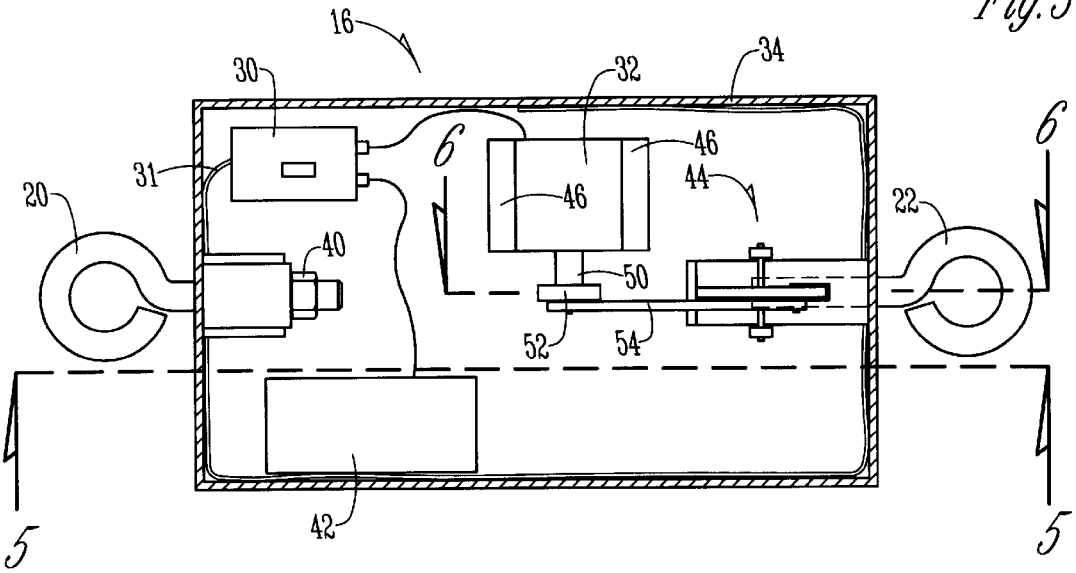
FIGS. 4–6 are cross sectional views of the present invention showing the internal workings of the present invention.
Figure 5:
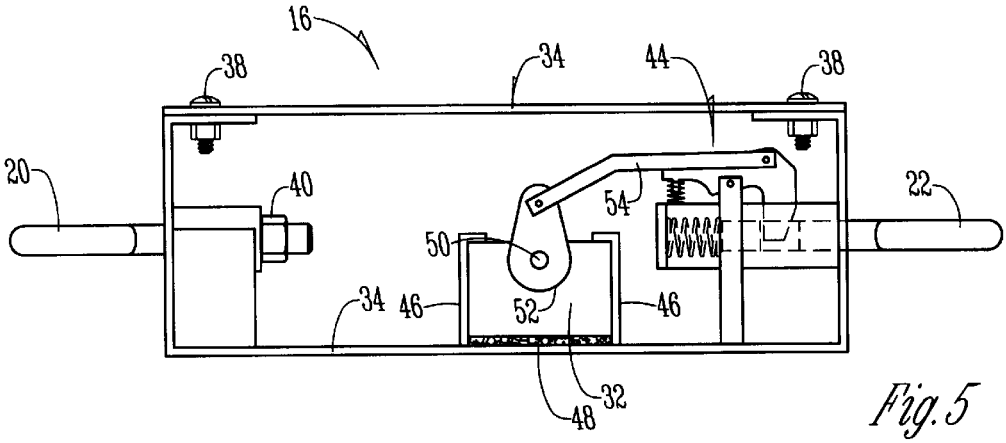
Figure 6:
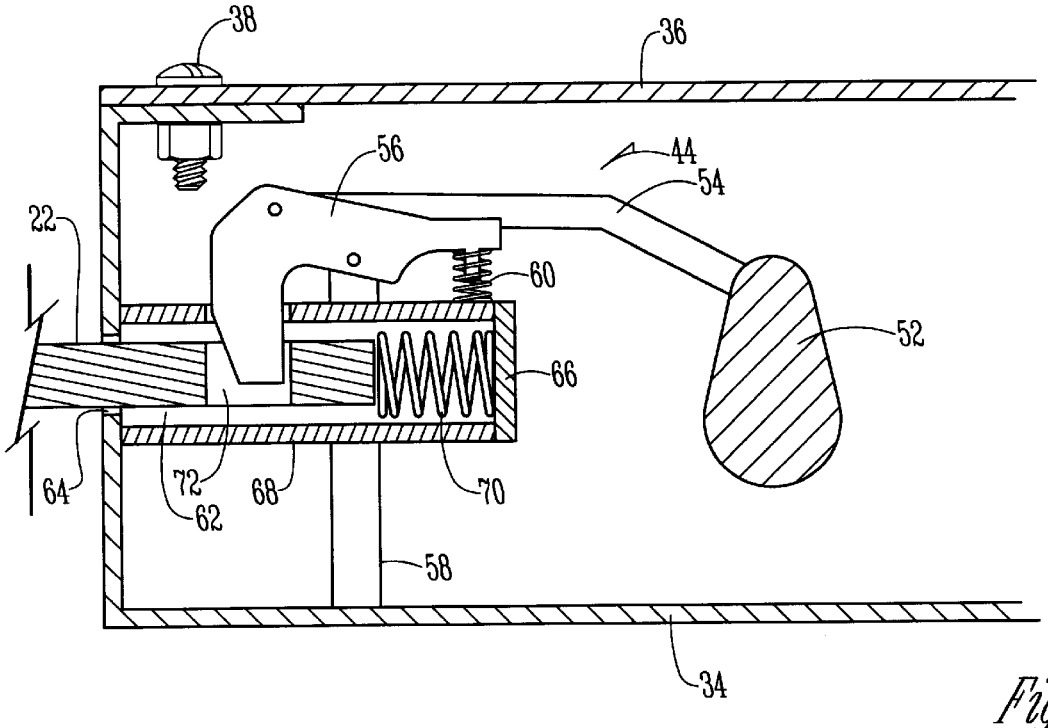

FIGS. 4–6 show detailed views of the releasable latch 16 of the present invention. The latch 16 is enclosed in a housing 34 which includes a lid 36 secured to the housing 34 by screws 38. The first threaded eyebolt 20 is rigidly secured to the housing 34 by a nut 40. Disposed within the housing 34 is a battery 42, the receiver 30, the antenna 31, a servo motor 32, and a latching assembly 44. The battery 42 supplies power to the transmitter 30 and the servo 32. The servo 30 acts to control the operation of the servo 32. The servo 32, in turn, controls the latching assembly 44.

As best shown in FIG. 5, the servo 32 is secured to the housing 34 by a pair of servo mounts 46. A layer of padding 48 is placed between the housing 34 and the servo 32 to secure the servo 32. The servo 32 includes a shaft 50 rigidly coupled to an arm 52 which is rotatably coupled to a servo extension rod 54. By activating the servo 32, the extension rod 54 will move generally back and forth. As shown in FIG. 6, the rod 54 is rotatably coupled to a slip locking pin 56. The slip locking pin 56 is rotatably mounted to a mount 58 so that the locking pin 56 is rotatably mounted relative to the housing 34 between a latched (FIG. 6) and an unlatched position (not shown). A cylindrical chamber 62 having opened and closed ends 64 and 66, respectively, is formed by a steel tube 68. A locking pin spring 60 is disposed between the locking pin 56 and the tube 68 to bias the locking pin in the latched position shown in FIG. 6. When the remote releasably latch 16 of the present invention is latched, the eyebolt 22 is disposed partially within the cylindrical chamber 62. A chamber spring 70 is disposed in the cylinder 62 to press against eyebolt 22. The spring 70 functions to press the eyebolt tightly against the locking pin 56 as well as ensure that the eyebolt 22 will exit the chamber 62 when desired. The eyebolt 22 is securely held within the chamber 62 by the locking pin 56 which is partially inserted in a hole 72 in the eyebolt 22.

The remote buckle release device 16 of the present invention operates as follows. When preparing a bull 12 or other rodeo animal for a contest, the bull rope 14 including the remote buckle release device 16 is attached to the bull 12 by wrapping the rope 14 around the chest of the bull 12 immediately behind the front legs. The rope is tightened to the desired tension by the rider by inserting the end of the rope 14 through a loop, pulling the rope 14 up, and wrapping the rope around the rider's hand so that the rope is very securely attached. The latching mechanism 44 will be in the position shown in FIGS. 4–6.

When the bull 12 is in the chute, the rider 10 is mounted on the bull 12 while grasping the bull rope 14. When the chute opens and the bull 12 starts to buck (FIG. 1), the bull rider 10 rides the bull 12 until a specified time period has expired or until the bull rider 10 is thrown from the bull 12. If the rider 10 is thrown from the bull 12, the rider 10 will attempt to release his hand from the bull rope 14 in order to escape from the bull 12 and avoid injury. In the unfortunate but common event that the bull rider 10 cannot separate his hand from the bull rope 14 after being thrown, another person can release the bull rope 14 using the remote control 24. When the person activates the transmitter 26 by pressing a button, a radio signal is transmitted and received by the receiver 30 within the buckle release device 16. The receiver 30 then sends a trigger signal to an electrical actuator such as servo 32. The servo 32 will then rotate causing the servo extension rod 54 to rotate the locking pin 56. When the locking pin 56 has rotated far enough, the pin 56 will no longer be inserted in the hole 72 in the eyebolt 22. At this point, the eyebolt 22 will pull out of the chamber 62 due to the tension on the bull rope 14 and also due to the pressure from the spring 70. When the eyebolt 22 exits the chamber 62, bull rope 14 will be released from the bull 12 which in turn releases the bull rider's hand and allows the rider 10 to escape from the bull 12 without injury. The entire process starting from when the person activates the transmitter 26 to the time when the bull rope 14 is released, takes place in a fraction of a second, giving the rider 10 the opportunity to escape before being injured. To use the bull rope 14 again, a user simply inserts the eyebolt 22 into the chamber 62 where the locking pin 56 will lock the eyebolt in place.

Although the present invention has been described as a device for use with a bull rope 14, the invention is not limited to that particular use. For example, the invention could be used as a remote release device for a saddle rigging used with saddle broncos.

The preferred embodiment of the present invention has been set forth in the drawings and specification, and although specific terms are employed, these are used in a generic or descriptive sense only and are not used for purposes of limitation. Changes in the form and proportion of parts as well as in the substitution of equivalents are contemplated as circumstances may suggest or render expedient without departing from the spirit and scope of the invention as further defined in the following claims.

What is claimed is:

1. A method of releasing a bull rope from a rodeo animal when a rider is thrown from the animal comprising the steps of:

providing a rope adapted to fit around the chest of the animal proximate the front legs of the animal to provide a handle for a rider of the animal;

providing an electrically actuated releasable fastening device coupled to the rope to releasably secure the rope around the chest of the animal;

providing a radio receiver operatively coupled to the electrically actuated fastening device;

observing the rider and the animal to determine if the rider has been thrown from the animal;

observing the rider to determine if the rider has a hand caught in the rope after being thrown from the animal;

transmitting a radio signal when the rider has been thrown from the animal and has a hand caught in the rope;

receiving said radio signal; and actuating said fastening device to release the rope from the animal and thereby allow the rider to fully detach from the animal in response to the received signal.

2. The method of claim 1 wherein the step of actuating said fastening device to release the rope from the animal further comprises the steps of:

providing a servo mechanism; and releasing the rope by activating the servo mechanism.

3. The method of claim 1 wherein the step of actuating said fastening device to release the rope from the animal further comprises the steps of:

providing a servo mechanism;

providing a locking pin operatively connected to the servo mechanism;

providing a release pin coupled to the rope and secured to the releasable fastening device by the locking pin;

activating the servo mechanism in response to the received signal; and uncoupling the locking pin from the release pin to release the rope from the releasable fastening device.

4. A method of releasing a bull rope from a bull when a bull rider is thrown from the bull comprising the steps of:

providing a releasable latching mechanism having a radio receiver, a servo mechanism, and locking pin;

securing the releasable latching mechanism to a first end of the bull rope;

operatively securing a second end of the bull rope to the locking pin;

wrapping the bull rope around the chest of the bull slightly behind the front legs of the bull in preparation for a bull ride;

observing the bull rider and the bull;

transmitting a signal when it is observed that the bull rider has been thrown from the bull;

receiving the signal;

activating the servo mechanism in response to the received signal; and releasing the bull rope by unsecuring the second end of the bull rope from the locking pin.

5. A remote release safety device for attaching a bull rope to an animal comprising:

a rope having a first and second end, said rope being adapted to fit around the chest of said animal behind and proximate to the front legs of said animal to provide a handle for a rider of the animal;

a releasable fastener coupled to said rope proximate said first end and releasably coupled to said rope proximate said second end of said rope;

a release member for releasably coupling said second end of said rope to said releasable fastener;

a remote radio transmitter;

a radio receiver operatively connected to said fastener for causing said fastener to release said rope when the appropriate signal is received from said radio transmitter;

a servo mechanism operatively connected to the radio receiver and operatively coupled to the release member for uncoupling the release member from the releasable fastener in response to a signal from the radio receiver;

a locking pin operatively coupled between the servo mechanism and the release member for releasably coupling the release member to the releasable fastener, wherein the locking pin has a locked position and an unlocked position, and wherein the locking pin couples the release member to the releasable fastener when in the locked position; and a hole formed in the release member, the hole being adapted to receive the locking pin when the locking pin is in the locked position.

6. The device of claim 5 further comprising a linkage connecting the servo mechanism to the locking pin.

7. The device of claim 5 further comprising a spring for biasing the locking pin in the locked position.

8. The device of claim 5 wherein the servo mechanism moves the locking pin from the locked position to the unlocked position in response to a signal received by the radio receiver.

9. The device of claim 5 further comprising a spring for biasing the release member toward the locking pin when the locking pin is in the locked position.

10. The device of claim 5 wherein the release member is comprised of an eyebolt.

11. The device of claim 5 further comprising an elongated chamber formed in the releasable fastener for receiving the release member and for receiving a portion of the locking pin.

12. The device of claim 11 further comprising a notch formed along a portion of the length of the elongated chamber for receiving the locking pin.

* * * * *